US006810558B2

(12) United States Patent
Lee

(10) Patent No.: US 6,810,558 B2
(45) Date of Patent: Nov. 2, 2004

(54) CYCLONE DUST COLLECTING APPARATUS FOR USE IN VACUUM CLEANER

(75) Inventor: Yong-hee Lee, Gwangju (KR)

(73) Assignee: Samsung Gwangji Electronics Co., Ltd., Gwangji (KR)

( * ) Notice: Subject to any disclaimer, the term of this patent is extended or adjusted under 35 U.S.C. 154(b) by 304 days.

(21) Appl. No.: 10/106,418

(22) Filed: Mar. 25, 2002

(65) Prior Publication Data

US 2003/0106182 A1 Jun. 12, 2003

(30) Foreign Application Priority Data

Dec. 12, 2001 (KR) ..... 2001-78582

(51) Int. Cl.[7] ..... A47L 9/10; B01D 45/12; B01D 50/00

(52) U.S. Cl. ..... 15/353; 55/337; 55/459.1; 55/459.3; 55/DIG. 3

(58) Field of Search ..... 15/347, 350–353, 15/327.1, 327.2, 327.7; 55/337, 459.1, 459.3, DIG. 3

(56) References Cited

U.S. PATENT DOCUMENTS

| | | | | | |
|---|---|---|---|---|---|
| 3,320,727 | A | * | 5/1967 | Farley et al. | 55/337 |
| 5,135,552 | A | * | 8/1992 | Weistra | 55/337 |
| 5,779,745 | A | * | 7/1998 | Kilstrom | 55/337 |
| 6,406,505 | B1 | | 6/2002 | Oh et al. | 55/337 |
| 6,613,129 | B2 | * | 9/2003 | Gen | 95/269 |

FOREIGN PATENT DOCUMENTS

| | | |
|---|---|---|
| DE | 201 09 699 U1 | 11/2001 |
| DE | 10132690 | 7/2002 |
| EP | 0 489 468 | 6/1992 |
| GB | 2 365 324 | 2/2002 |
| GB | 2 368 005 | 4/2002 |
| NL | 1017217 | 2/2002 |
| WO | WO 97/12660 | 4/1997 |
| WO | WO 00/49933 | 8/2000 |
| WO | WO 00/74548 | 12/2000 |
| WO | WO 01/60524 | 8/2001 |

OTHER PUBLICATIONS

Search and Examination Report issued from the British Patent Office in respect to British Application No. 0226170.9.

Search Report issued from the Dutch Industrial Property Office with respect to Dutch Application No. 1020578.

Examination Report issued from the German Patent Office in respect to German Application No. 10222656.3.

* cited by examiner

*Primary Examiner*—Robert J. Warden, Sr.
*Assistant Examiner*—Laura C Cole
(74) *Attorney, Agent, or Firm*—Westman, Champlin & Kelly P.A.

(57) ABSTRACT

In a cyclone dust collecting apparatus for use in a vacuum cleaner, mounted in a dust collecting chamber intercommunicating with a motor driving chamber of a cleaner body, for separating contaminants from an air that is drawn in through a suction brush by a centrifugal force, the cyclone dust collecting apparatus includes: a contaminant receptacle having a contaminant chamber and an air discharge chamber, the contaminant chamber and the air discharge chamber respectively having open upper sides and partitioned from each other; a cyclone unit connected to an upper portion of the contaminant receptacle in a manner of covering the contaminant chamber and the air discharge chamber, the cyclone unit having a hole corresponding to, respectively, an incoming air port through which foreign substance laden air flows in, a centrifuging chamber for separating the foreign substances from the air by a centrifugal effect, a contaminant discharge port through which the separated foreign substances are discharged, an outgoing air port through which cleaned air that is left after separation of the foreign substances is discharged out, and the air discharge chamber; and a duct member connected to the upper portion of the cyclone unit, and having an air inflow channel that is connected to the incoming air port and an air outflow channel that interconnects the outgoing air port with the hole.

8 Claims, 2 Drawing Sheets

CYCLONE DUST COLLECTING APPARATUS FOR USE IN VACUUM CLEANER

The present application is based on and claims the benefit of Korean patent application Serial No. 2001-78582, filed Dec. 12, 2001, the content of which is hereby incorporated by reference in its entirety.

BACKGROUND OF THE INVENTION

1. Field of the Invention

The present invention relates to a vacuum cleaner, and more particularly, to a cyclone dust collecting apparatus for use in a vacuum cleaner that separates contaminants from air by a centrifugal force and collecting the separated dust.

2. Description of the Related Art

Generally, an upright type or canister type vacuum cleaner has a suction brush connected to a cleaner body and moved along the cleaning surface. The cleaner has a dust collecting chamber in which a dust filter is removably mounted, and a motor driving chamber in which a motor is mounted to provide a suction force. In the vacuum cleaner of the above construction, when the motor is driven, a strong suction force is generated at the suction brush. By the suction force, air laden with contaminants or dust of the cleaning surface is drawn into-the cleaning body. After being drawn into the cleaner body, the air flows through the dust filter mounted in the dust collecting chamber of the cleaner body, and at this time, the contaminant or dust are filtered at the dust filter. Then the air is discharged out via the motor driving chamber.

However, the problem is that a user of the conventional vacuum cleaner has to buy the dust filters that are consumables, in order to ensure the appropriate collecting of the dust or contaminant. Also, when the dust filter is full of contaminants, the user has to change the dust filter with his/her own hands, which is quite unhygienic and inconvenient.

SUMMARY OF THE INVENTION

The present invention has been made to overcome the above-mentioned problems of the related art, and accordingly, it is an object of the present invention to provide a cyclone dust collecting apparatus for use in a vacuum cleaner that could separate dust and contaminant from the air drawn into a cleaner body through a suction brush by a centrifugal force and collecting the separated dust and contaminant.

In order to accomplish the above object of the present invention, in a cyclone dust collecting apparatus for use in a vacuum cleaner, mounted in a dust collecting chamber intercommunicating with a motor driving chamber of a cleaner body, for separating contaminants from an air that is drawn in through a suction brush by a centrifugal force, the cyclone dust collecting apparatus according to the present invention includes: a contaminant receptacle having a contaminant chamber and an air discharge chamber, the contaminant chamber and the air discharge chamber respectively having open upper sides and partitioned from each other; a cyclone unit connected to an upper portion of the contaminant receptacle in a manner of covering the contaminant chamber and the air discharge chamber, the cyclone unit having a hole corresponding to, respectively, an incoming air port through which foreign substance laden air flows in, a centrifuging chamber for separating the foreign substances from the air by a centrifugal effect, a contaminant discharge port through which the separated foreign substances are discharged, an outgoing air port through which cleaned air that is left after separation of the foreign substances is discharged out, and the air discharge chamber; and a duct member connected to the upper portion of the cyclone unit, and having an air inflow channel that is connected to the incoming air port and an air outflow channel that interconnects the outgoing air port with the hole.

The cyclone unit includes a centrifuging receptacle having an open upper end and a closed lower end, and a cylindrical side having the contaminant discharge port formed therein; a cover plate connected to an outside of the centrifuging receptacle, covering the contaminant chamber and the air discharge chamber, the cover plate having the hole formed therein; and a cap cover removably mounted on the centrifuging receptacle in a manner of covering the open end of the centrifuging receptacle, the cap cover having the incoming air port and the outgoing air port.

The cyclone unit also includes a grill member having an open upper end intercommunicating with the incoming air port of the cap cover, and a plurality of fine holes formed in a side, and mounted in an interior of the centrifuging receptacle.

The grill member includes a cylindrical body integrally formed on a bottom of the centrifuging receptacle, and having open upper and lower ends; and a lower cover connected to cover the open lower end of the cylindrical body.

The outgoing air port is formed in the center of the cap cover, and the incoming air port is formed at an end of an air guide groove that is formed in near to the outgoing air port in a spiral manner.

The centrifuging receptacle has one or more locking groove formed in the upper end, and the locking groove receives a locking protrusions protruding from a rim of the cap cover to be locked in the locking groove.

The cap cover has at least a pair of handle holes formed in an upper side of the cap cover, for rotating the cap cover for locking/unlocking of the cap cover.

The cover plate and the centrifuging receptacle are integrally formed with each other.

In between the cyclone unit and the duct member, a sealing member is provided.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

The preferred embodiment of the present invention will now be described with reference to the drawings.

Figure 1:
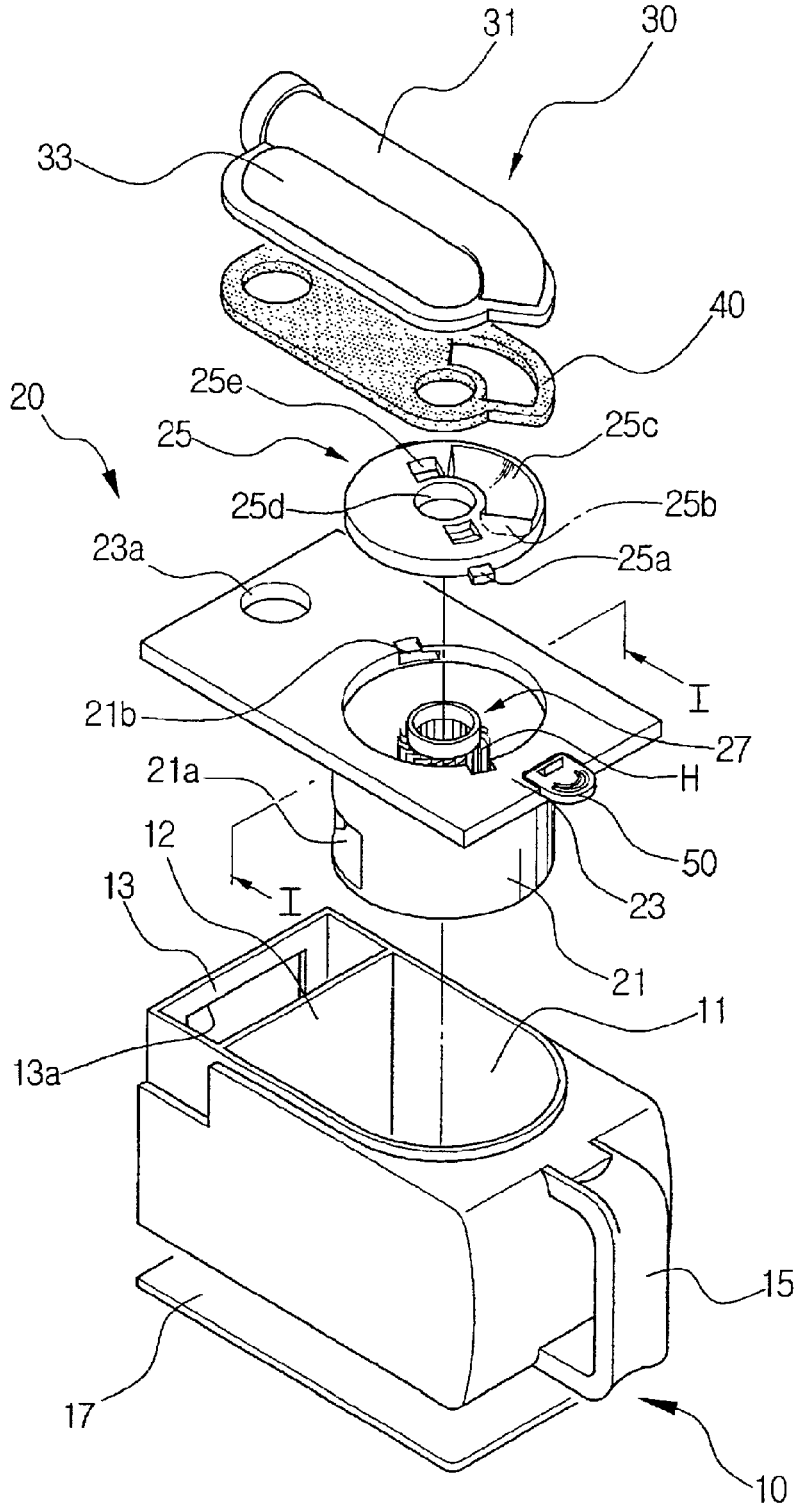
FIG. 1 is an exploded perspective view for schematically showing a cyclone dust collecting apparatus for use in a vacuum cleaner according to the preferred embodiment of the present invention.

Referring to FIG. 1, the cyclone dust collecting apparatus for use in vacuum cleaner according to the preferred embodiment of the present invention includes a contaminant receptacle 10, a cyclone unit 20 connected to an upper portion of the contaminant receptacle 10, and a duct member 30 connected to the upper portion of the cyclone unit 20.

The contaminant receptacle 10 has a contaminant chamber 11 and an air discharge chamber 13, each having an open upper side, respectively. The contaminant chamber 11 and the air discharge chamber 13 are partitioned by a partition 12. The contaminant chamber 11 receives the contaminants that are separated from the air by the centrifugal force in the cyclone unit 20. The air discharge chamber 13 is a passage through which the clean air from the cyclone unit 20 flows, and is intercommunicating with the motor driving chamber 3 provided in the cleaner body 1 (See FIG. 3). Accordingly, in order to connect the air discharge chamber 13 to the motor driving chamber 3, an opening 13*a* can be provided at one side of the air discharge chamber 13. Provided on the outer surface of the contaminant receptacle 10 is a handle 15. Constructed as described above, the contaminant receptacle 10 is removably mounted in the dust collecting chamber that is intercommunicating with the motor driving chamber. Further, in order for a user to empty the contaminant receptacle 10 easily, a removable base 17 is provided. The contaminant receptacle 10, the cyclone unit 20 and a cap cover 25 are connected into one assembly, and removably mounted in the dust collecting chamber 2 intercommunicating with the motor driving chamber 3.

The cyclone unit 20 separates foreign substances from the air drawn through the suction brush by the centrifugal force. The cyclone unit 20 includes a centrifuging receptacle 21, a cover plate 23 connected to the upper end of the centrifuging receptacle 21, a cap cover 25 connected to the upper end of the centrifuging receptacle 21, and a grill member 27 mounted in the centrifuging receptacle 21.

The upper side of the centrifuging receptacle 21 is opened, whereas the lower side is closed. Formed in the cylindrical side of the centrifuging receptacle 21 is a contaminant discharge port 21*a* of a predetermined size. The centrifuging receptacle 21 is accommodated in the contaminant chamber 11 when being connected to the contaminant chamber 11. The cover plate 23 is integrally formed on the outer surface of the centrifuging receptacle 21. The cover plate 23 is connected to the upper portion of the contaminant receptacle 10 to cover the contaminant chamber 11 and the air discharge chamber 13. The cover plate 23 has a hole 23*a* formed therein intercommunicating with the air discharge chamber 13. Also formed on the cover plate 23 is a separating button 50. If the separating button 50 is movably formed on the cover plate 23, then a locking protrusion is formed on the upper surface of the separating button 50. Accordingly, as the cover plate 23, connected with the contaminant receptacle 10, is received into the dust chamber 2, the locking protrusion of the separating button 50 is inserted in a locking groove formed on the cleaner body 1 and the cyclone unit 20 is mounted in the cleaner body 1. If the user presses the separating button 50 in the lock state, the locking protrusion is released from the locking groove, and thus, the cyclone unit 20 is separated from the cleaner body 1.

The cap cover 25 is removably connected to the open upper end of the centrifuging receptacle 21. A pair of locking protrusions 25*a* is protruding from the rim of the cap cover 25. Formed on the upper end of the centrifuging receptacle 21, i.e., formed on the linking area between the centrifuging receptacle 21 and the cover plate 23, is a pair of locking grooves 21*b* corresponding to the pair of locking protrusions 25*a*.

Further, formed in the cap cover 25 is an incoming air port 25*b* through which the foreign-substance laden air flows. More specifically, an air guiding groove 25*c* is formed in a spiral manner and spaced from the center of the cap cover 25 in an outward direction, and the incoming air port 25*b* is formed at the end of the air guiding groove 25*c*. Accordingly, while the air flows into the centrifuging receptacle 21 along the air guiding groove 25*c*, the centrifugal force is generated.

Formed at the center of the cap cover 25 is an outgoing air port 25*d* through which the cleaned air flows after the foreign substances are removed by the centrifugal force. A pair of handle holes 25*e* is provided in near to the outgoing air port 25*d*. Accordingly, by placing the cap cover 25 on the upper side of the centrifuging receptacle 21 and rotating the cap cover 25 with fingers at the handle holes 25*e*, the user can lock or release the locking protrusions 25*a* in/from the locking grooves 21*b*, easily.

Figure 2:
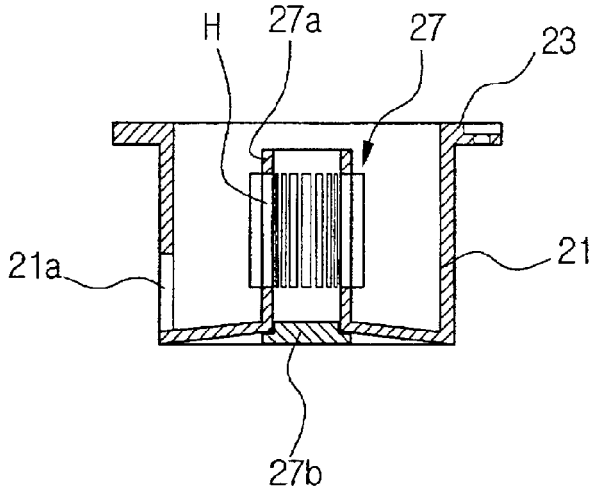
FIG. 2 is a sectional view taken along line I—I of FIG. 2.

As shown in FIG. 2, the grill member 27 has a cylindrical shape, and includes a grill body 27*a* protruding from the bottom of the centrifuging receptacle 21, and a lower cover 27*b* that opens and closes the open lower side of the grill body 27*a*. A plurality of fine holes (H) is formed in the grill body 27*a* in a circumferential direction. The grill body 27*a* is integrally formed with the bottom of the centrifuging receptacle 21. The bottom 27*a* of the centrifuging receptacle 21 is inclined downwardly outside, thereby accelerating the centrifugal effect. The open upper side of the grill body 27*a* is connected to the outgoing air port 25*d* of the cap cover 25. Accordingly, after separation of the foreign substances from the air in the centrifuging receptacle 21, the cleaned air is discharged out through the fine holes (H), whereas the foreign substances are filtered and discharged through the contaminant discharge port 21*a*.

The duct member 30 includes an air inflow channel 31 connected to the incoming air port 25*b*, and an air discharge port 33. Through the air inflow channel 31, the air drawn in from the suction brush flows to the incoming air port 25*b*. An end of the air inflow channel 31 is formed in a spiral manner to correspond to the air guiding groove 25*c*. Accordingly, the air drawn into the incoming air port 25*b* from the air inflow channel 31 is guided in a spiral pattern.

The air discharge channel 33 connects the outgoing air port 25*d* of the cap cover 25 to the hole 23*a* of the cover plate 23. Accordingly, the clean air, discharged through the outgoing air port 25*d*, flows to the air discharge chamber 13 via the air discharge channel 33, and is discharged into the motor driving chamber 3.

Disposed between the duct member 30 and the cyclone unit 20 is a sealing member 40. The sealing member 40 blocks a leakage from air flow, and also prevents deterioration of the suction pressure. Preferably, the sealing member 40 is secured in between the duct member 30 and the cleaner body 1 by screws for sealing.

Further, the duct member 30 constructed as above is connected to the cleaner body 1. Accordingly, when mounting or separating the cyclone unit 20 to/from the cleaner body 1, the cyclone unit 20 is connectible or separable by, for example, a surface contact.

The operation of the cyclone dust collecting apparatus for use in the vacuum cleaner constructed according to the preferred embodiment of the present invention will be described below.

Figure 3:
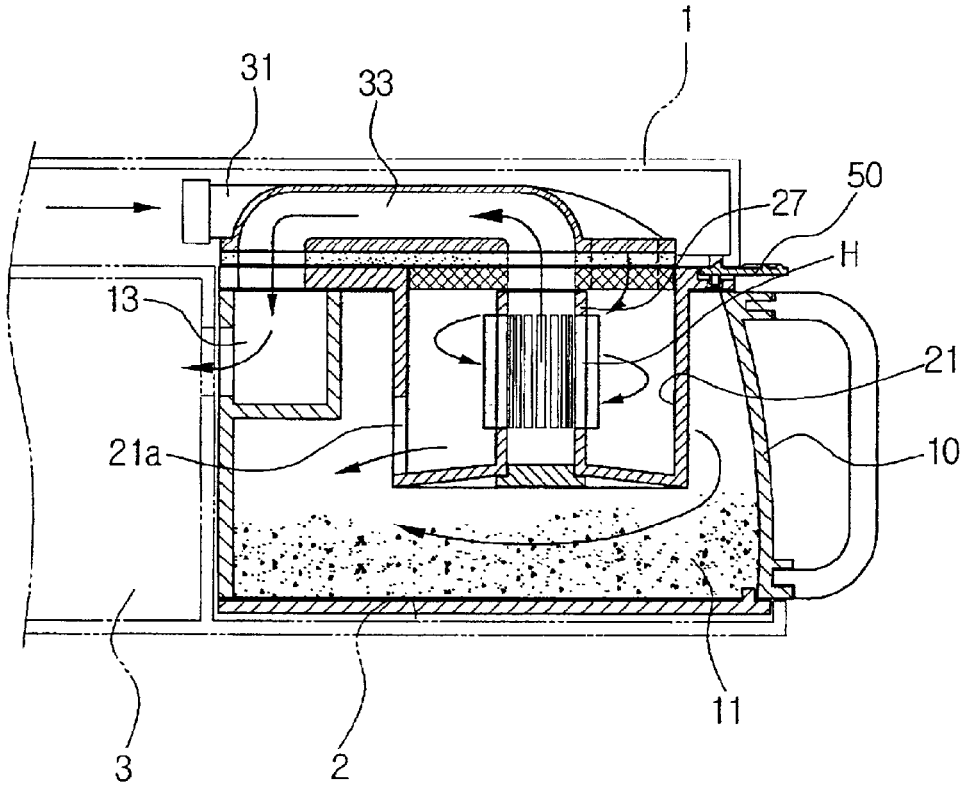
FIG. 3 is a sectional view for schematically showing the cyclone dust collecting apparatus of FIG. 1 being assembled.

First, as shown in FIG. 3, the air is drawn in through the suction brush, and flows into the centrifuging receptacle 21 via the air suction channel 31. When the air is drawn in, the air is guided to rotate in a spiral pattern, generating a centrifugal force that separates foreign substances from the air. The foreign substances separated from the air are collected in the contaminant chamber 11 of the contaminant receptacle 10 through the contaminant discharge port 21*a*.

After the foreign substances are removed from the air, the clean air passes through the fine holes (H) of the grill member 27 and is discharged through the air discharge channel 33. After that, the air is discharged into the motor driving chamber through the air discharge chamber 13.

When the contaminant receptacle 10 is filled with foreign substances, the user separates the cyclone unit 20 from the contaminant receptacle 10, and then empties the contaminant receptacle 10.

In order to clean the interior of the centrifuging receptacle 21, the user separates the cap cover 25 from the centrifuging receptacle 21 and cleans the interior.

As described above, with the cyclone dust collecting apparatus for use in the vacuum cleaner according to the preferred embodiment of the present invention, foreign substances in the air are filtered out easily, without having to use a dust bag. Further, since the user can empty the contaminant receptacle 10 easily, it becomes easy to use and also, it becomes hygienic.

Further, since the components are easy to assemble and disassemble, maintenance becomes simpler.

While the invention has been shown and described with reference to the preferred embodiment thereof, it will be understood by those skilled in the art that various changes in form and details may be made therein without departing from the sprit and scope of the invention as defined by the appended claims.

What is claimed is:

1. A cyclone dust collecting apparatus for use in a vacuum cleaner, mounted in a dust collecting chamber intercommunicating with a motor driving chamber of a cleaner body, for separating contaminants from an air that is drawn in through a suction brush by a centrifugal force, the cyclone dust collecting apparatus comprising:

a contaminant receptacle having a contaminant chamber and an air discharge chamber, the contaminant chamber and the air discharge chamber respectively having open upper sides and partitioned from each other;

a cyclone unit connected to an upper portion of the contaminant receptacle in a manner of covering the contaminant chamber and the air discharge chamber, the cyclone unit having a hole corresponding to, respectively, an incoming air port through which foreign substance laden air flows in, a centrifuging chamber for separating the foreign substances from the air by a centrifugal effect, a contaminant discharge port through which the separated foreign substances are discharged, an outgoing air port through which cleaned air that is left after separation of the foreign substances is discharged out, and the air discharge chamber, the cyclone unit comprising:

a centrifuging receptacle having an open upper end, a closed lower end and a cylindrical side that has the contaminant discharge port formed therein;

a cover plate connected to an outside of the centrifuging receptacle, covering the contaminant chamber and the air discharge chamber, the cover plate having the hole formed therein;

a cap cover removably mounted on the centrifuging receptacle in a manner of covering the open end of the centrifuging receptacle, the cap cover having the incoming air port and the outgoing air port; and a duct member connected to the upper portion of the cyclone unit, and having an air inflow channel that is connected to the incoming air port and an air outflow channel that interconnects the outgoing air port with the hole.

2. The cyclone dust collecting apparatus of claim 1, wherein the cyclone unit further comprises a grill member having an open upper end intercommunicating with the incoming air port of the cap cover, and a plurality of fine holes formed in a side, the cyclone unit being mounted in an interior of the centrifuging receptacle.

3. The cyclone dust collecting apparatus of claim 2, wherein the grill member comprises:

a cylindrical body integrally formed on a bottom of the centrifuging receptacle, and having open upper and lower ends; and a lower cover connected to cover the open lower end of the cylindrical body.

4. The cyclone dust collecting apparatus of claim 1, wherein the outgoing air port is formed in the center of the cap cover, and the incoming air port is formed at an end of an air guide groove that is formed in near to the outgoing air port in a spiral manner.

5. The cyclone dust collecting apparatus of claim 1, wherein the centrifuging receptacle has one or more locking groove formed in the upper end, and the locking groove receives a locking protrusions protruding from a rim of the cap cover to be locked in the locking groove.

6. The cyclone dust collecting apparatus of claim 5, wherein the cap cover has at least a pair of handle holes formed in an upper side of the cap cover, for rotating the cap cover for locking/unlocking of the cap cover.

7. The cyclone dust collecting apparatus of claim 1, wherein the cover plate and the centrifuging receptacle are integrally formed with each other.

8. The cyclone dust collecting apparatus of claim 1, wherein, in between the cyclone unit and the duct member, a sealing member is provided.

* * * * *